US005216983A

United States Patent [19]

Nilson

[11] Patent Number: 5,216,983

[45] Date of Patent: Jun. 8, 1993

[54] VEHICLE HYDRAULIC COOLING FAN SYSTEM

[75] Inventor: Carl A. Nilson, Jackson, Mich.

[73] Assignee: Harvard Industries, Inc., Jackson, Mich.

[21] Appl. No.: 966,378

[22] Filed: Oct. 26, 1992

[51] Int. Cl.[5] ..... F01P 7/02

[52] U.S. Cl. ..... 123/41.12; 123/41.49

[58] Field of Search ..... 123/41.11, 41.12, 41.49, 123/41.31; 417/405; 60/468

[56] References Cited

U.S. PATENT DOCUMENTS

| | | | |
|---|---|---|---|
| 2,777,287 | 1/1958 | Tweedale | 60/12 |
| 3,220,640 | 11/1965 | Kambs | 230/270 |
| 3,659,567 | 5/1972 | Murray | 123/41.12 |
| 3,934,644 | 1/1976 | Johnston | 165/51 |
| 4,062,329 | 12/1977 | Rio | 123/41.12 |
| 4,066,047 | 1/1978 | Vidakovic et al. | 123/41.12 |
| 4,223,646 | 9/1980 | Kinder | 123/41.11 |
| 4,461,246 | 7/1984 | Clemente | 123/41.12 |
| 4,489,680 | 12/1984 | Spokas et al. | 123/41.05 |
| 4,941,437 | 7/1990 | Suzuki et al. | 123/41.49 |
| 5,095,691 | 3/1992 | Yoshimura | 123/41.49 |

*Primary Examiner*—Noah P. Kamen

*Attorney, Agent, or Firm*—Beaman & Beaman

[57] ABSTRACT

A hydraulic cooling system for vehicles utilizing a hydraulic pump driven by the vehicle engine, the pump, preferably, having high and low volume chambers, a shroud adapted to be associated with the vehicle engine cooling radiator, a fan driven by hydraulic fluid pressurized by the pump for producing air flow through the shroud and the engine cooling radiator, and the hydraulic circuit between the pump and the fan motor includes a reservoir and a control valve sensitive to the engine coolant temperature. The control valve is located within the reservoir, and the reservoir is mounted upon the shroud and includes heat exchanging fins exposed to the air passage within the shroud. The entire combination of components may be pre-assembled and shipped and installed as a unit.

17 Claims, 3 Drawing Sheets

VEHICLE HYDRAULIC COOLING FAN SYSTEM

BACKGROUND OF THE INVENTION

1. Field of the Invention

The invention pertains to a cooling system for internal combustion engines cooled by a radiator wherein the engine drives a hydraulic pump which in turn powers a cooling fan for pulling air through the engine radiator.

2. Description of the Related Art

For years, fans have been used to draw air through the radiators of internal combustion engines for the purpose of lowering the temperature of the engine coolant. Initially, such fans were directly powered by the engines and, often, belt systems were employed. With the advent of front wheel drive vehicles using cross mounted engines, the radiator cooling fans have often been powered by electric motors, and even in present engines having crankshafts extending parallel to the length of the vehicle, electric motors have been used to drive the radiator cooling fan in view of the versatility of installation and the ease of location of such system components as to accommodate themselves to the aerodynamic configuration and other space limitations of the vehicle.

While internal engine cooling fans driven by electric motors are suitable in many light duty installations, electric motors are not suitable for powering fans under heavy duty requirements as the size of the electric motor must be significantly increased as compared to lighter duty installations and the electric drain on the vehicle electrical system is enormous. Further, larger electric motors are very expensive and their size defeats the advantages attained with smaller electric motors.

It has been recognized that in heavier duty installations wherein the engine cooling fan is to be directly driven by a separate motor, that a hydraulic fan motor powered by a pump driven by the vehicle engine is capable of transmitting the necessary power to the fan and also meeting the required space and versatility prerequisites. Relatively high horsepower can be produced by hydraulic drive systems for permitting the engine to transfer to the fan the required power, and typical hydraulically driven engine cooling fan systems are shown in U.S. Pat. Nos. 2,777,287; 3,220,640; 3,659,567; 3,934,644; 4,062,329; 4,066,047; 4,223,646; 4,461,246 and 4,489,680. The hydraulically driven engine cooling fan systems disclosed in the aforementioned patents are, for the most part, not suitable for present day designs, require expensive components, are time consuming and expensive to install, and often are not capable of being located in the limited space of engine compartments of present low-silhouette vehicles. Further, known prior art hydraulic fan systems cannot readily be installed as an entire system, necessitating skilled installers and significant time durations for installation.

OBJECTS OF THE INVENTION

It is an object of the invention to provide a hydraulically powered internal combustion engine cooling system assembly wherein all of the required components may be pre-assembled for installation in the vehicle as a unit.

Another object of the invention is to provide a hydraulic cooling system for internal combustion engines wherein the assembly includes a shroud defining an air passage between the engine radiator and the fan, and a heat exchanger for the hydraulic system is located within the shroud air passage.

Yet another object of the invention is to provide a hydraulic cooling system for internal combustion engines wherein the hydraulic circuit for the pump and fan motor includes a reservoir mounted upon a shroud defining an air passage between the engine radiator and fan, and the reservoir includes heat exchanging vanes located within the shroud air passage.

A further object of the invention is to provide a hydraulic cooling system for vehicles employing an engine driven pump and a hydraulically driven fan, the hydraulic circuit including a reservoir and an engine controlled primary control valve which is located within the reservoir.

An additional object of the invention is to provide a hydraulic cooling system for vehicles employing a hydraulic pump driven by the vehicle engine, the pump being of the gerotor type having high and low volume chambers, and separate control valves are in communication with each chamber for regulating the velocity of the fan motor in dependence upon the engine cooling requirements or air conditioning requirements.

Yet another object of the invention is to provide a hydraulic cooling system assembly unit for vehicles wherein the assembly includes a pump adapted to be driven by the engine, a fan, a hydraulic motor driving the fan, a shroud defining an air passage between the engine radiator and fan, a reservoir, heat exchanger and control valve, the entire hydraulic circuit being capable of being fully charged with hydraulic fluid prior to installation in the vehicle.

SUMMARY OF THE INVENTION

The invention takes the form of a hydraulic cooling system for vehicles, i.e. a cooling system for internal combustion engines using a radiator to lower the temperature of the engine coolant by transferring the heat of the coolant to the ambient air. The cooling system consists of a hydraulic pump adapted to be driven by the associated engine. Through conduits, the pumped pressurized fluid is transferred to a hydraulic fan motor such that the fan is rotated as the motor is energized by the pumped fluid.

The hydraulic circuit includes a reservoir to which the pump is connected, and a primary control valve which is located within the reservoir is controlled by a servo valve which is adjusted in accordance with engine characteristics, such as the temperature of the engine coolant. Accordingly, the control valve determines the amount of pressurized fluid supplied to the fan motor, and hence, controls the speed of rotation of the fan.

The hydraulic motor, fan and reservoir are mounted upon a shroud which is adapted to be supported within the engine compartment such that one shroud end is disposed adjacent the engine radiator, while the fan is located within the other shroud end. Accordingly, as the fan is rotated it forces air through the shroud air passage aiding in the flow of air through the engine radiator to reduce the engine coolant temperature.

In accord with the invention, the reservoir is mounted upon the shroud wall, and the reservoir includes heat conducting vanes which are located within the shroud air passage. Thus, as air flows through the shroud it flows over the reservoir heat exchanger vanes and cools the hydraulic oil within the reservoir to prevent overheating of the oil.

The hydraulic pump preferably includes high volume and low volume chambers, and the output from each chamber is connected to a separate primary control valve such that the proper fan rate of rotation can be achieved regardless of the rate of engine rotation. The control valves regulate the rate of fan rotation by permitting excess fluid to be discharged into the reservoir.

As the pump, motor, reservoir, control valves, and the conduits interconnecting the same, can be assembled and charged with hydraulic fluid prior to the entire assembly, including the shroud, being placed within the vehicle engine compartment the cooling system assembly of the invention simplifies installation over previous cooling system installations, and minimizes the likelihood of errors arising during the assembly of components, as is the case with on-site assembly usually employed with vehicle cooling systems.

BRIEF DESCRIPTION OF THE DRAWING

The aforementioned objects and advantages of the invention will be appreciated from the following description and accompanying drawings wherein.

DESCRIPTION OF THE PREFERRED EMBODIMENT

Figure 1:
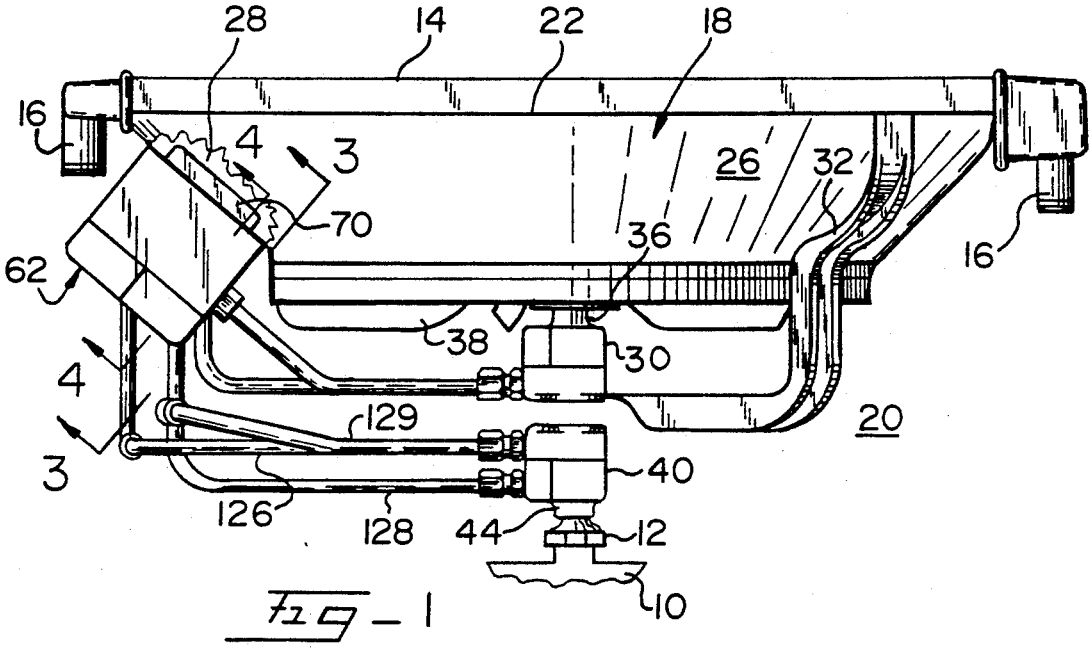
FIG. 1 is a top plan view of a hydraulic vehicle cooling system assembly in accord with the invention, a portion of the shroud being broken away, and a portion of the engine drive being illustrated.
Figure 2:
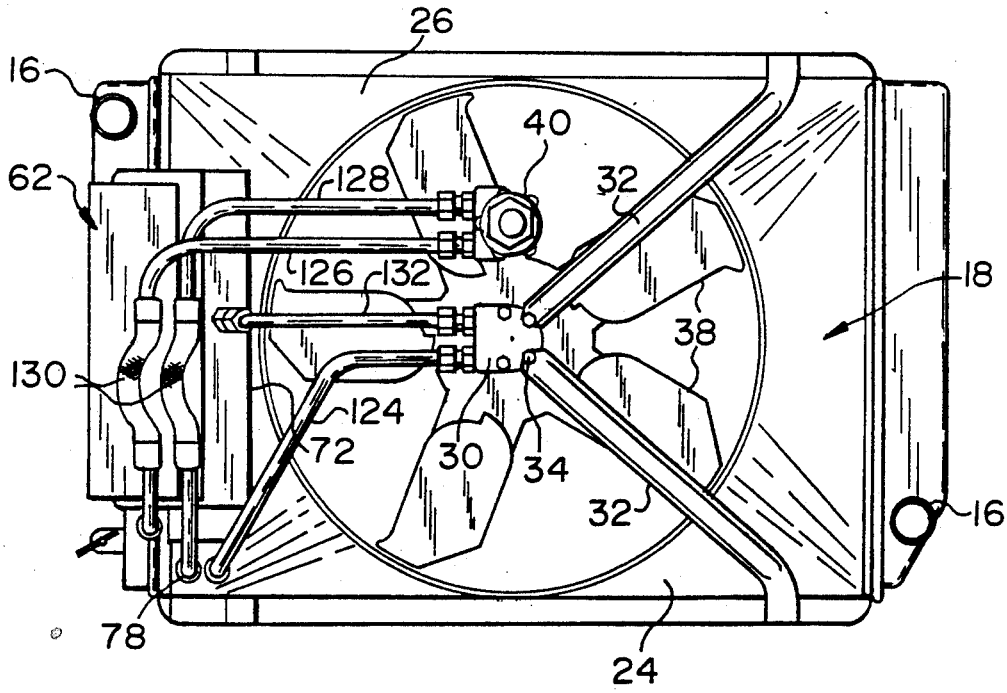
FIG. 2 is a rear elevational view of the cooling system assembly of FIG. 1.

The components of an internal combustion engine cooling system assembly utilizing the concepts of the invention will be appreciated from FIGS. 1 and 2.

With reference to FIG. 1, the front end of an internal combustion engine, not shown, includes a rotating pulley or drive member 10 having a threaded adapter 12 mounted thereon for rotation with the drive member. The engine compartment also includes a radiator 14, of conventional construction having a core, fins, and hose fittings 16. The engine coolant is pumped through the radiator 14 through hose attached to the fittings 16, not shown, and in the usual manner, air passing through the radiator will cool the engine coolant.

The assembly of the invention includes a shroud 18 which is mounted within the vehicle engine compartment 20 on the radiator 14, or adjacent the radiator 14. The shroud 18 may be formed of sheet metal, plastic, or a composition material which is of a relatively stiff characteristic, and capable of supporting the weight of the reservoir as will be described. The shroud 18 includes a large open end 22 disposed adjacent the radiator 14 which is of an area substantially equal to the radiator area through which air flows. The other end of the shroud 18 is defined by the circular opening 24 in which the fan is located, and as the area of the end 22 is greater than the area of the opening 24, the shroud wall 26 converges in the direction toward the opening 24. That area within the shroud 18 between the end 22 and the opening 24 constitutes an air passage 28.

A hydraulic motor 30 of the gerotor type is concentrically supported in alignment with the center of the circular opening 24 by a pair of brackets 32 affixed at their outer end to the shroud end 22, or these brackets may be, alternatively, attached at their outer ends to vehicle support structure, not shown. Preferably, the brackets 32 are affixed to vehicle supported portions of the shroud 18. At their inner ends the brackets 32 are bolted to the motor 30 at 34.

The motor 30 includes a drive shaft 36 concentric with the axis of the opening 24, and a fan 38 is mounted upon the drive shaft 36. As will be appreciated from FIG. 2, the diameter of the fan blades is slightly less than the diameter of the opening 24, and the fan blades will be located within the opening. Rotation of the motor 30 pulls air through the shroud passage 28 through the radiator 14 in the direction toward the viewer of FIG. 2.

The hydraulic pressure required to drive the motor 30 is produced by a pump 40 driven by the drive member adapter 12. The pump 40 is of the gerotor type having a drive shaft 42, FIGS. 6 and 7, and the outer end of the drive shaft is provided with a cup 44 internally threaded to receive the threaded adapter 12. In this manner the rotation of the drive member 10 will rotate the drive shaft 42.

The pump 40 is of the gerotor type and includes the housing 46 having the conventional fluid flow channels defined within the pump interior walls and chambers. While a single chamber pump may be used, in the preferred pump embodiment, the pump includes a large volume rotor 48 keyed to the shaft 42 at 50 and the teeth of the rotor 48 cooperate with the teeth of the stator 52. The channels 54 defined in the housing 46 communicate with the spacing between the teeth of the rotor 48 and the stator 52 to pump fluid in the known manner. The channels 54 associate with conventional inlet and outlet ports, not shown.

A rotor 56 is also keyed to the drive shaft 42 and the teeth of the rotor 56 cooperate with the teeth of the stator 58. Channels 60 defined in the housing 46 cooperate with inlet and outlet ports, not shown, defined in the housing 46.

Figure 6:
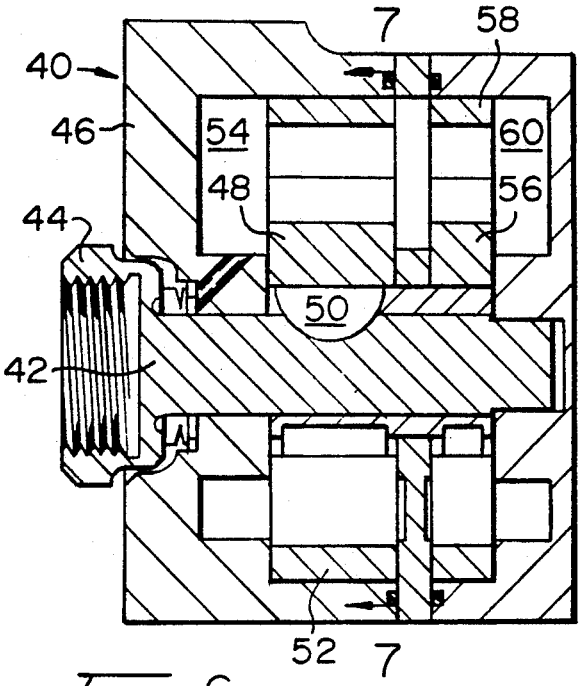
FIG. 6 is a diametrical elevational sectional view taken through the hydraulic pump.

As will be appreciated from FIG. 6, the axial length of the rotor 48 and stator 52 is substantially twice that of the axially length of the rotor 56 and stator 58. Accordingly, the rotor 48 and stator 52 define a large volume pump chamber while the rotor 56 and stator 58 define a small volume pump chamber. The large volume pump chamber is capable of pumping approximately twice the volume of the small chamber. Both pump chambers will be operating during rotation of the drive shaft 42.

Figure 3:
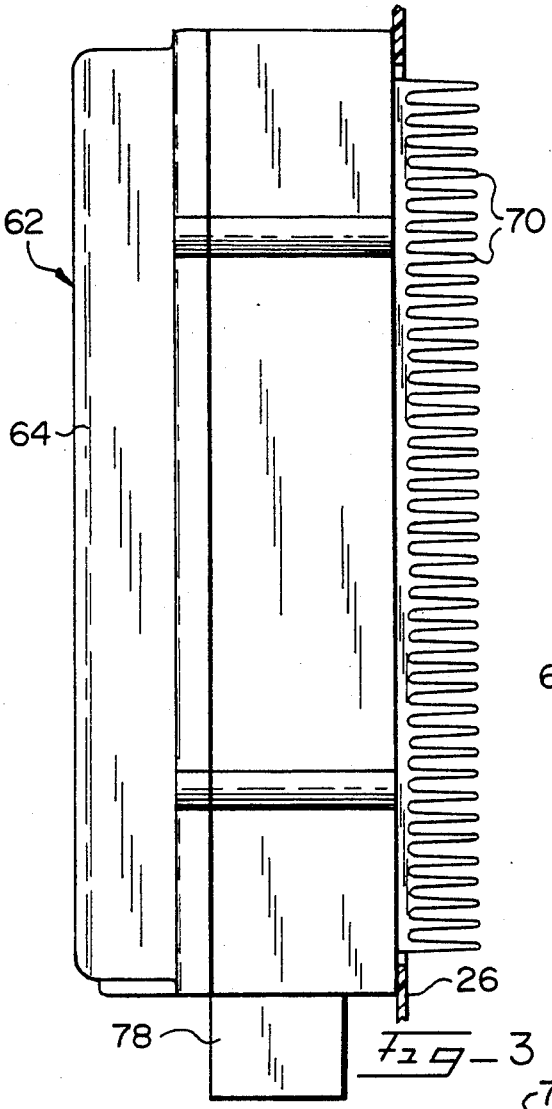
FIG. 3 is a side elevational view of the reservoir, per se, no conduits being illustrated, as taken along Section 3—3 of FIG. 1.
Figure 4:
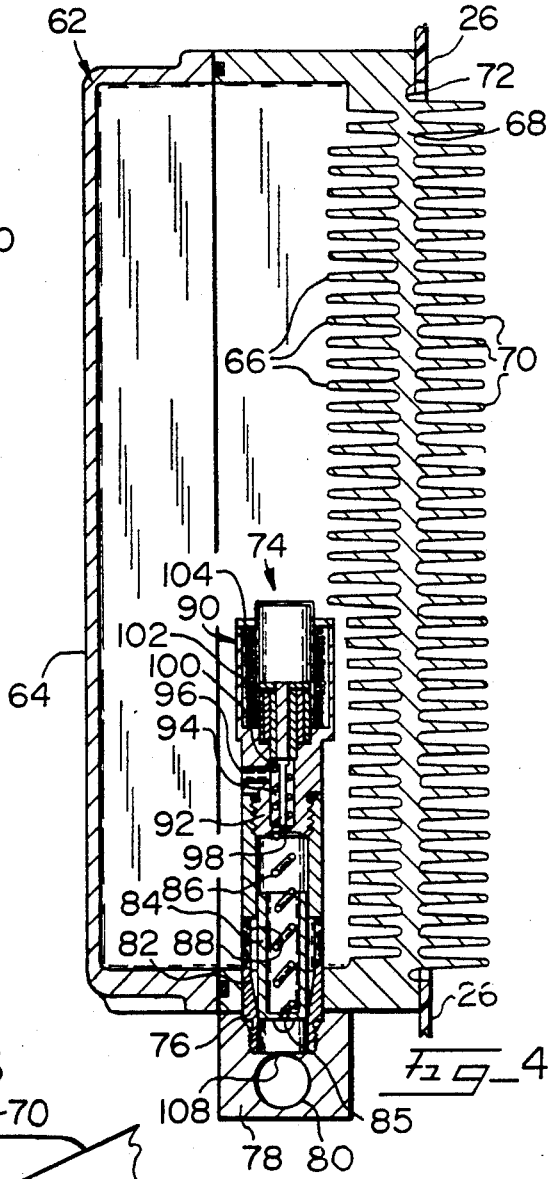
FIG. 4 is a sectional, elevational, cross sectional view taken through the reservoir along Section 4—4 of FIG. 1.

The hydraulic circuit includes a reservoir 62, which may be of a cast aluminum construction, and the configuration of the reservoir is best appreciated from FIGS. 3 and 4. The reservoir includes a removable cover 64, bolted in place, and a side wall of the reservoir, internally, is provided with a plurality of fins or vanes 66 in direct contact with the hydraulic oil within the reservoir. Of course, the purpose of the vanes 66 is to increase the surface contact of the oil with the reservoir side 68. The reservoir side 68 is externally provided with a plurality of fins or vanes 70 to permit the heat transfered to the reservoir side 68 by the vanes 66 to be dissipated into the air within the shroud air passage 28. In this respect, the reservoir 62 is mounted within an opening 72 defined in the shroud wall 26 such that the vanes 70 will be located within the shroud air passage 28 as will be appreciated from FIG. 1. Accordingly, the air flowing through the shroud passes over the vanes 70 and cools the hydraulic oil within the reservoir 62.

The primary control valve for controlling the flow of pressurized fluid from the pump 40 to the fan motor 30 is located within the reservoir 62. The control valve is generally indicated at 74, and is entirely encased within the reservoir 62.

With reference to FIG. 4, the control valve 74 includes a tubular housing 76 having a lower end extending to the reservoir boss 78 in which the oil passage 80 is defined. The oil passage 80 receives pressurized oil through a conduit from the pump 40. Internally, the housing 76 is provided with a conical port 82, and a valve 84 is biased by spring 86 into the port 82. A bleed orifice 85 is defined through the face of valve 84. Discharge ports 88 are defined in the housing 76 in communication with the conical port 82, but fluid flow from the oil passage 80 to the outlet ports 88 is prevented when the valve 84 is in the closed position as shown in FIG. 4. As the valve 84 "rises" in the conical port 82 increasingly greater clearance exists between the valve 84 and the conical port 82 permitting a greater amount of pressurized oil to pass from passage 80 through outlet ports 88 into the reservoir 62.

The position of the valve 84 is controlled by a servo valve 90 which includes a housing 92 threaded into the upper end of the tubular housing 76. The housing 92 includes a cylindrical passage 94 having a discharge port 96 at its upper end communicating with the reservoir 62, and at its lower end the passage 94 communicates with a small orifice 98 which is in communication with the interior of the tubular housing 76 above the valve 84.

A needle valve 100 is reciprocally mounted within the passage 94 upon a ferromagnetic armature 102, and the lower end of the needle valve 100 will seal the orifice 98 at the lowermost position of the armature 102.

The position of the armature 102 is regulated by the electrical coil 104, and the electrical coil 104 is energized by an electrical circuit, not shown, sensing the temperature of the engine coolant, such as exists within the engine radiator 14 and/or other engine or vehicle characteristics. For instance, the electrical coil 104 may be energized by an output from the vehicle computer system which, in addition to sensing the temperature of the engine coolant, may also be sensing the engine RPM, vacuum, and other factors which may have a bearing upon engine temperature or vehicle requirements.

A control valve 74 is associated with the outputs of each of the chambers of the pump 40, and for purposes of distinction, although the control valves are identical, the identical control valve components will be identified by primed reference numerals. The control valve 74 controls the fluid pumped by the large rotor 48 and stator 52 to the fan motor 30, while the control valve 74', FIG. 10, controls the flow of fluid pumped by the smaller rotor 56 and stator 58. Both the control valves 74 and 74' are located within the reservoir 62 and include input passages defined within the reservoir boss 78.

Figure 5:
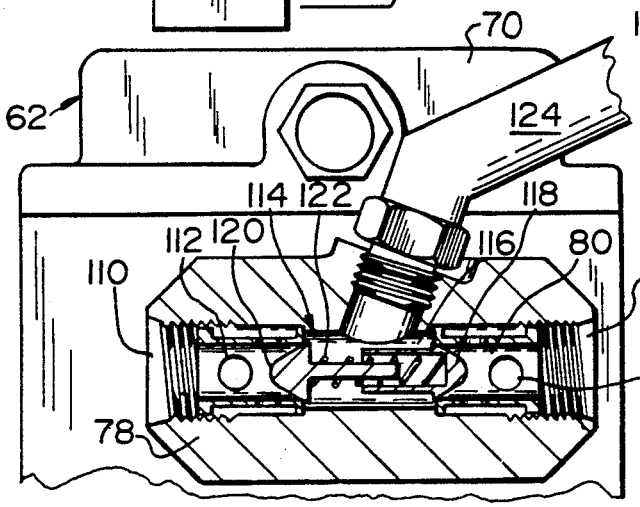
FIG. 5 is a detail bottom sectional view as taken through the bottom boss of the reservoir, and illustrating the double check valve of the circuitry.

FIG. 5 is a sectional view through the boss 78 illustrating the arrangement of a portion of the hydraulic circuitry. A conduit threaded into port 106 in communication with the pump rotor 48 and stator 52 provides pressurized fluid to the control valve 74 through the opening 108, while the threaded port 110 communicates with the pressurized output of pump rotor 56 and stator 58, and communicates with control valve 74' through opening 112.

A check valve or shuttle valve assembly 114 is located within the boss passage 116 and the check valve assembly 114 includes the valve head 118 and valve head 120. The valve heads 118 and 120 are biased apart by the spring 122, and the valve heads prevent flow from the passage 116 into the openings 108 and 112. The passage 116 communicates with the motor pressurized conduit 124 constituting the supply of pressurized fluid to the fan motor 30.

The aforedescribed hydraulic components are interconnected by rigid conduits, and the pump 40 is supplied with hydraulic oil from the reservoir 62 through the conduit 126. Conduits 128 and 129 represent the outlet conduits from the pump 40 as connected to ports 106 and 110. Flexible sections 130 are included in the conduits 126, 128 and 129 which are of a stiff, and yet flexible nature, to permit ready alignment of the pump 40 with the drive member adapter 12 during installation, and the sections 130 also reduce the transmission of vibration and motor movement to the vehicle cooling assembly.

The discharge from the fan motor 30 to the reservoir 62 is through conduit 132.

Figure 7:
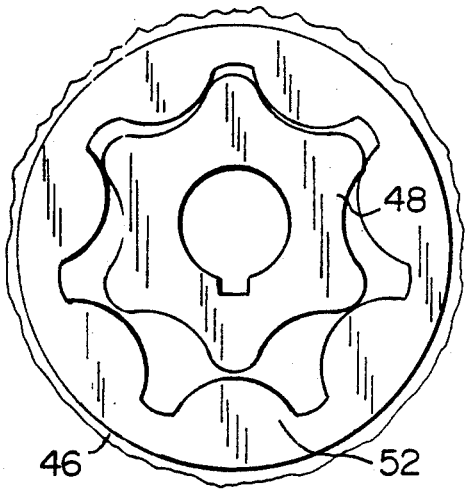
FIG. 7 is an elevational sectional view of the gerotor pump rotor mechanism as taken along Section 7—7 of FIG. 6.
Figure 8:
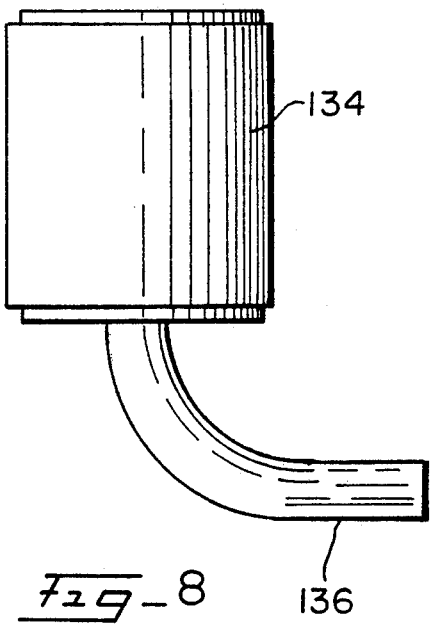
FIG. 8 is a plan view of the filter located within the reservoir.
Figure 9:
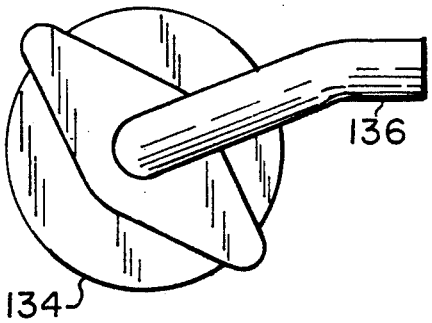
FIG. 9 is an end elevational view of the filter as taken from the bottom of FIG. 8.

The discharge of hydraulic oil from the motor 30 into the reservoir 62 is through a filter 134 which is shown in FIGS. 7 and 8. The filter 134 includes a fine screen, and the filter is supplied by the conduit 136 which is attached to the motor discharge conduit 132. The screen of the filter 134 may be periodically cleaned upon removal of the reservoir cover 64 after draining of the reservoir and hydraulic system.

Figure 10:
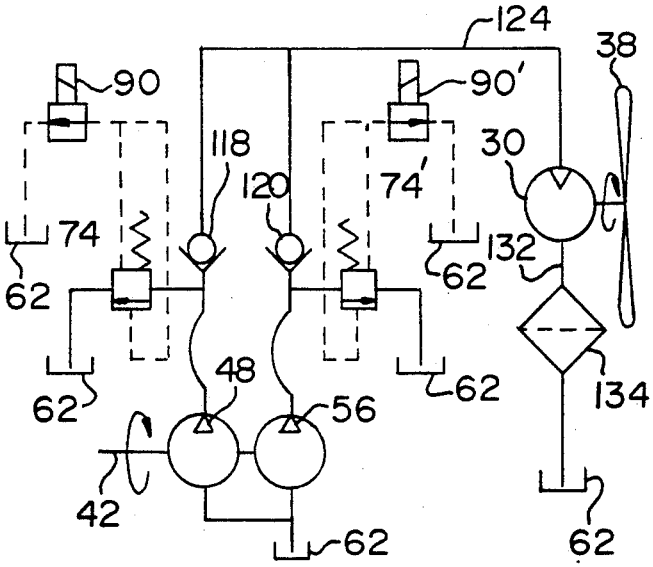
FIG. 10 is a schematic representation of the hydraulic circuit used with the practice of the invention employing a pump having high and low volume chambers.

With reference to the schematic circuit diagram shown in FIG. 10, the control valve and service valve components are identified as described above. The check valve assembly 114 is shown in its simpler form as to two separate check valves, but it will be appreciated that the operation of the check valve assembly 114 will be identical to the separate valve illustration of FIG. 10 or a shuttle check valve having a single check element located between spaced valve seats selectively engaging a seat.

The operation and position of the valve 84 of control valve 74 is determined by the differential pressures, and spring pressure, bearing on the pressure faces of the valve 84. Fluid pressure enters the valve 84 and housing 76 through the bleed orifice 85, and as long as the needle valve 100 is not closing the orifice 98 the pressurized fluid passing through the bleed orifice 85 will be discharged through the orifice 98, passage 94 and discharge port 96 into the reservoir 62. However, if the armature 102 has been permitted to be lowered due to the electrical characteristics of the coil 104 the needle valve 100 will close the orifice 98 permitting the fluid pressure within the housing 76 to build up and act upon the upper side of the valve 84 as represented in FIG. 4. The fluid pressure acting upon the upper pressure faces of the valve 84, in conjunction with the force imposed on the valve by the spring 86, are sufficient to move the valve 84 into the conical port 82 to close off the escape of pressurized fluid from the oil passage 80 through the outlet ports 88, and direct all of the fluid within passage 80 into the motor pressurized conduit 124 by unseating the valve head 118. When the engine temperature, and the engine RPM, are at predetermined conditions the coil 104 is energized such as to raise the armature 102 to remove the needle valve 100 from the orifice 98 permitting fluid within the housing 76 to be discharged through port 96 to the reservoir 62. In such instance the valve 84 will be displaced upwardly within the conical port 82 permitting oil to escape around the valve 84 and enter the reservoir 62 through the outlet ports 88. Accordingly, it will be appreciated that by using a relatively small amount of electrical energy at coils 104 the significant pump pressures created by pump 40 can be accurately controlled to rotate the motor 30 and fan 38 at the desired rates of rotation.

Under normal operating conditions, the control valves 74 and 74' may both be partially opened to supply fluid under equal pressures through check valves 118 and 120. Of course, the control circuits controlling the coils 104 and 104' of the servo valves 90 and 90' can be set up such that under normal operating conditions only the control valve 74 and the pumping achieved by rotor 48 and stator 52 is used to drive the fan motor 30. This is a matter of choice with the vehicle designer, and is only a matter of regulating the electrical characteristics being provided to the coils 104 and 104'.

However, under high loads, for instance when the vehicle is traversing a steep hill, or pulling a trailer or load up a steep hill, the vehicle transmission will downshift substantially increasing the engine RPM. Such an increase in the engine RPM will drive the pump 40 at a greater rate of rotation and significantly increase the output of pump 40 to a value greater than that required to efficiently operate the fan motor 30. In such instance of high engine rates of rotation, the electrical circuitry associated with coils 104 and 104' is such that the control valve 74 is fully opened to discharge the high volume of fluid being pumped by rotor 48 into the reservoir 62, and the control valve 74' receiving the output from small rotor 56 and stator 58 is used to drive the fan motor 30. Accordingly, by using a pump having two rates of volume discharge, and utilizing separate control valves for the two pump outputs, the increased pump output due to higher engine revolutions does not create hydraulic problems or motor overload which would result in objectionable increases in hydraulic oil temperatures.

The mounting of the reservoir 62 upon the shroud 18, and the mounting of the fan motor 30 upon the brackets 32, and the conduits connecting the pump 40 to the reservoir 62 permits these components to be pre-assembled and pre-charged with hydraulic oil prior to locating and mounting the assembly within the vehicle engine compartment. By forming the vanes 70 upon the reservoir 62, and locating the vanes within the shroud air passage 28, an effective cooling of the hydraulic oil within the reservoir is achieved in a minimum of space, and the assembly of the invention readily lends itself to the low silhouette and crowded engine compartments of modern vehicles.

It is appreciated that various modifications to the inventive concepts may be apparent to those skilled in the art without departing from the spirit and scope of the invention.

I claim:

1. A hydraulic cooling system for vehicles having an internal combustion engine cooled by a radiator and a coolant, comprising, in combination, a shroud adapted to be mounted adjacent the radiator having a wall forming an air passage and defining a first port disposed adjacent the radiator and a second port spaced from said first port, a fan located within said second port, a hydraulic fan motor operatively connected to said fan, a hydraulic pump operatively connected to the engine for producing a pressurized hydraulic fluid flow, a hydraulic circuit interconnecting said pump to said fan motor, said circuit including a control valve, a hydraulic fluid reservoir and a heat exchanger, said heat exchanger being mounted within said shroud air passage.

2. In a hydraulic cooling system for vehicles as in claim 1, said heat exchanger being mounted upon said shroud wall.

3. In a hydraulic cooling system for vehicles as in claim 1, said reservoir and heat exchanger comprising a single unit, said reservoir and heat exchanger unit being mounted upon said shroud wall whereby said heat exchanger is located within said shroud air passage.

4. In a hydraulic cooling system for vehicles as in claim 3, said reservoir comprising a closed receptacle having a wall, said heat exchanger comprising outwardly extending vanes defined upon said receptacle wall.

5. In a hydraulic cooling system for vehicles as in claim 4, said control valve being located within said reservoir receptacle.

6. In a hydraulic cooling system for vehicles as in claim 1, said hydraulic pump having a high volume output and a low volume output.

7. In a hydraulic cooling system for vehicles as in claim 6, said hydraulic circuit including a control valve for each pump output.

8. A pre-assembled hydraulic cooling assembly for internal combustion engines comprising, in combination, a shroud having a wall defining an air passage having an air inlet and an air outlet, a fan located within said air outlet, a hydraulic motor operatively connected to said fan, an oil reservoir mounted on said shroud wall, an oil heat exchanger mounted on said shroud wall within said air passage, a hydraulic pump having a drive adapter for attachment to an engine drive, a control valve, and conduits interconnecting said motor, reservoir, pump, heat exchanger and control valve.

9. In a pre-assembled hydraulic cooling assembly as in claim 8, said heat exchanger being integrally incorporated into said reservoir.

10. In a pre-assembled hydraulic cooling assembly as in claim 9, said control valve being located within said reservoir.

11. In a pre-assembled hydraulic cooling assembly as in claim 8, said control valve being located within said reservoir.

12. In a pre-assembled hydraulic cooling assembly as in claim 8, said motor, pump, control valve and conduits being pre-charged with oil prior to installation in a vehicle.

13. In a pre-assembled hydraulic cooling assembly as in claim 9, said reservoir comprising a closed receptacle having a wall, said heat exchanger comprising outwardly extending vanes defined upon said receptacle wall.

14. In combination, a fan for cooling an internal combustion engine, a rotary hydraulic motor operatively connected to said fan, a dual output rotary hydraulic pump having a drive adapter for attachment to an engine drive, said pump having a first high volume chamber and a second low volume chamber, a reservoir, control valve means, and a hydraulic circuit operatively interconnecting said motor, pump, reservoir and control valve means, said control valve means regulating the rate of rotation of said motor in dependency upon the engine characteristics and regulating the flow of oil from said pump chambers to said reservoir and motor as required to maintain a predetermined engine temperature.

15. In a combination as in claim 14, said control valve means including first and second control valves, said pump first chamber being connected to said first control valve and said pump second chamber being connected to said second control valve.

16. In a combination as in claim 14, said control valve means being located within said reservoir.

17. In a combination as in claim 14, heat exchanger vanes defined on said reservoir.

* * * * *